US011814271B2

(12) United States Patent
Konate et al.

(10) Patent No.: US 11,814,271 B2
(45) Date of Patent: Nov. 14, 2023

(54) SYSTEM FOR THE STORAGE AND TRACTION OF A CABLE, IN PARTICULAR A SYNTHETIC CABLE FITTED TO AN OFFSHORE CRANE

(71) Applicant: REEL, Saint-Cyr-Au-Mont-d'or (FR)

(72) Inventors: Karamoko Konate, Saint-Rogatien (FR); Mickael Valet, L'Houmeau (FR)

(73) Assignee: REEL, Saint-Cyr-au-Mont-d'Or (FR)

( * ) Notice: Subject to any disclaimer, the term of this patent is extended or adjusted under 35 U.S.C. 154(b) by 200 days.

(21) Appl. No.: 17/365,534

(22) Filed: Jul. 1, 2021

(65) Prior Publication Data

US 2022/0002120 A1 Jan. 6, 2022

(30) Foreign Application Priority Data

Jul. 3, 2020 (FR) ..... 2007075

(51) Int. Cl.
*B66D 1/74* (2006.01)
*B66C 23/52* (2006.01)
*B66D 1/38* (2006.01)

(52) U.S. Cl.
CPC ..... *B66D 1/741* (2013.01); *B66C 23/52* (2013.01); *B66D 1/38* (2013.01)

(58) Field of Classification Search
CPC ... B66D 1/38; B66D 1/68; B66D 1/74; B66D 1/76; B66D 1/7405; B66D 1/741; B66C 23/52
See application file for complete search history.

(56) References Cited

U.S. PATENT DOCUMENTS 4,921,219 A * 5/1990 Ottemann ..... B66D 1/44 254/284
5,215,272 A 6/1993 Sauber
7,134,645 B1 11/2006 Johnson et al.
2018/0201489 A1* 7/2018 Schmidt ..... B66D 1/7415
2018/0346296 A1 12/2018 Bjornevik

FOREIGN PATENT DOCUMENTS

EP 2 178 784 4/2010
WO 2009/016317 2/2009
WO 2018/131995 7/2018

OTHER PUBLICATIONS

Search Report for FR Application No. 2007075 dated Mar. 18, 2021, 1 page.

* cited by examiner

*Primary Examiner* — Sang K Kim
*Assistant Examiner* — Nathaniel L Adams
(74) *Attorney, Agent, or Firm* — NIXON & VANDERHYE

(57) ABSTRACT

Disclosed is a system for the storage and traction of a cable, in particular a synthetic cable fitted to an offshore crane. The storage/traction system includes a frame that carries in particular a storage device including a support carrying a storage reel through an assembly defining an axis of rotation. Between the storage reel and the support, the assembly includes of a single slewing ring including two rings that are free to rotate with respect to each other: —a fixed ring that is fastened to the support; and —a moving ring that is, on the one hand, fastened to the storage reel and, on the other hand, rotated by a motorization.

18 Claims, 3 Drawing Sheets

SYSTEM FOR THE STORAGE AND TRACTION OF A CABLE, IN PARTICULAR A SYNTHETIC CABLE FITTED TO AN OFFSHORE CRANE

CROSS-REFERENCE TO RELATED APPLICATIONS

This application claims priority to French Patent Application No. 2007075 filed Jul. 3, 2020, the entire contents of which are hereby incorporated by reference.

BACKGROUND OF THE INVENTION

Field of the Invention

The present invention relates to the technical field of offshore cranes. It more particularly relates to the systems for the storage and traction of a cable, in particular a synthetic cable fitted to an offshore crane.

Description of the Related Art

In offshore field, it is common that the vessels used are equipped with at least one crane. Certain cranes consist for example in knuckle boom cranes.

Cranes are useful, without being limited thereto, for the installation or dismantling of the transport infrastructures, the on-board reparations or operations.

To perform the operations, these cranes are conventionally provided with a system for the storage and traction of the cable that is intended to be attached to the load to be moved.

Such a storage/traction system comprises for that purpose a frame that carries a combination of devices cooperating with said cable:

(i) a storage device including:
- a storage reel on which said cable is intended to be wound,
- a support, carrying said storage reel through assembly means defining an axis of rotation, and
- a motorization, adapted to rotate said storage reel about said axis of rotation, (ii) a traction device, adapted to exert a traction on said cable, wherein said traction device includes at least one drum associated with a motorization, and (iii) a winding device, interposed between said storage device and said traction device, for guiding the cable during the winding/unwinding thereof with respect to said storage reel.

But most of the current storage/traction systems are relatively heavy and bulky. Now, these parameters are among the essential points in the design of an offshore vessel.

There hence exists a need for technical solutions for optimizing the structure of these storage/traction systems (especially in terms of weight and size).

SUMMARY OF THE INVENTION

In order to remedy the above-mentioned drawback of the state of the art, the present invention proposes a new structure for such a storage/traction system.

More particularly, it is proposed, according to the invention, a system for the storage and traction of a cable, in particular a synthetic cable fitted to an offshore crane.

The storage/traction system comprises a frame that carries a combination of devices cooperating with said cable:

(i) a storage device including:
- a storage reel on which said cable is intended to be wound,
- a support, carrying said storage reel through assembly means defining an axis of rotation, and
- a motorization, adapted to rotate said storage reel about said axis of rotation, (ii) a traction device, adapted to exert a traction on said cable, wherein said traction device includes at least one drum associated with a motorization, and (iii) a winding device, interposed between said storage device and said traction device, to guide the cable during the winding/unwinding thereof with respect to said storage reel.

And, according to the invention, between said storage reel and said support, said assembly means consist of a single slewing ring comprising two rings that are free to rotate with respect to each other:
- a fixed ring that is fastened to said support, and
- a moving ring that is, on the one hand, fastened to said storage reel and, on the other hand, rotated by said motorization.

The storage/traction system according to the invention has hence for interest to be lighter, and less bulky, than the current storage/traction systems (including a combination of slewing rings).

Other non-limitative and advantageous features of the product according to the invention, taken individually or according to all the technically possible combinations, are the following:
- the storage reel comprises a cylindrical barrel (ended by two flanges), wherein said cylindrical barrel comprises two cylindrical surfaces (an outer surface, around which the cable is intended to be wound, and an opposite, inner surface), and the motorization of said storage device is implanted opposite said outer surface and/or said inner surface;
- the motorization of said storage device comprises at least two motors, preferably three motors, regularly distributed over the circumference of said slewing ring;
- the moving ring includes a toothing and in that the motorization of said storage device includes a driving pinion meshing with said toothing;
- the storage reel includes two end edges, and the slewing ring is positioned at one of said end edges of the storage reel;
- said storage reel is assembled to the support through said assembly means defining a vertical axis of rotation; preferably, the storage reel includes two end edges (an upper end edge and a lower end edge), and the slewing ring is located at said upper end edge; still preferably, said frame comprises a base on which said devices are implanted, wherein said storage device is located under said base, said traction device is located above said base, and said winding device is implanted laterally with respect to said base, and said base also includes means for the lateral fastening to said offshore crane;
- the motorization is carried by a shaft that is fastened to the frame and arranged coaxially to said axis of rotation, said shaft being surrounded by said storage reel, as the case may be by the inner surface of the cylindrical barrel;
- said traction device consists of a capstan winch, that is composed of two motorized drums, positioned opposite each other and each including a cylindrical peripheral surface provided with several annular grooves, juxtaposed and coaxial to each other, said cable being intended to be wound about said two drums in a helical arrangement, the strands of said cable passing successively from one of the annular grooves of a drum to one of the annular grooves of the other drum, and the axis of rotation of said two motorized drums is directed perpendicular or at least approximately perpendicular to the axis of rotation of the storage reel.

The present invention also relates to an offshore crane equipped with a storage/traction system according to the invention.

Of course, the different features, variants and embodiments of the invention may be combined with each other according to various combinations insofar as they are not incompatible or exclusive of each other.

BRIEF DESCRIPTION OF THE DRAWINGS

Moreover, various other features of the invention emerge from the appended description made with reference to the drawings that illustrate non-limitative embodiments of the invention, and wherein.

DESCRIPTION OF THE PREFERRED EMBODIMENTS

It is to be noted that, in these figures, the structural and/or functional elements common to the different variants may have the same references.

Figure 1:
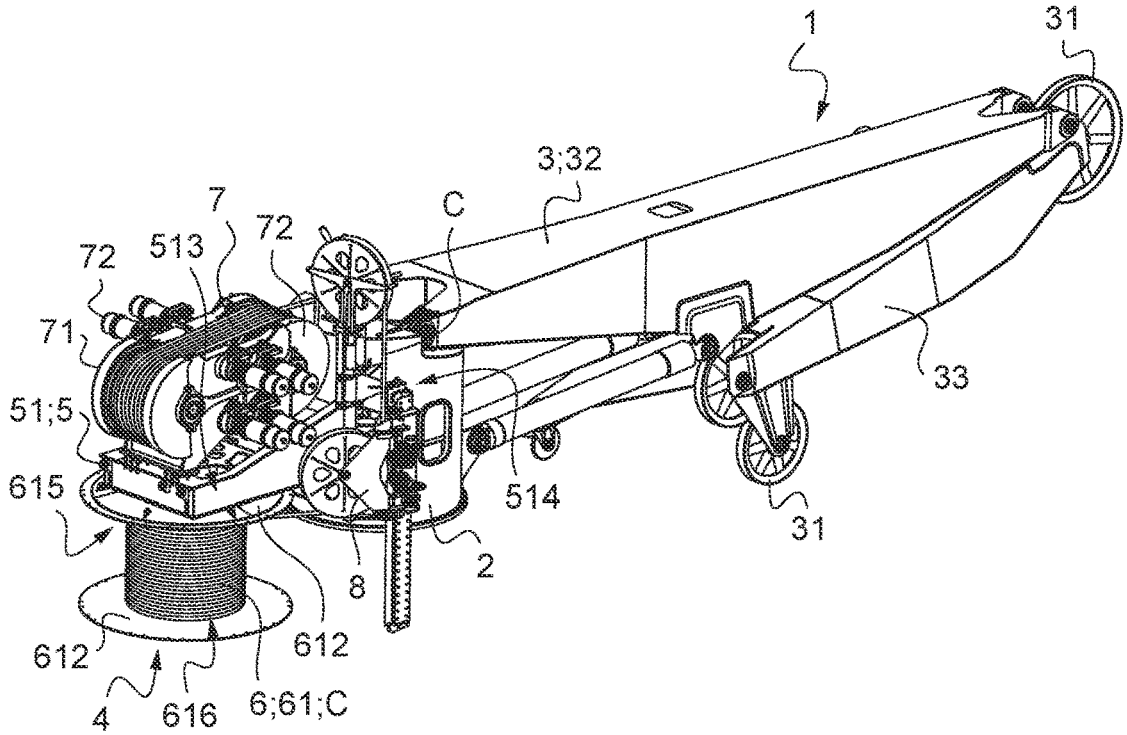
FIG. 1 is a general perspective view of an offshore crane equipped with the storage/traction system according to the invention.

The offshore crane 1 (also called "crane 1"), generally illustrated in FIG. 1, is adapted to offshore applications.

Such a crane 1 is advantageously designed to be installed on a vessel for offshore application (not shown—also called "offshore vessel"). This crane 1 is hence adapted to be taken on board the "offshore" vessel.

The term "vessel" includes for example the vessels (in particular, marine vessels), in particular the ships, the floating cranes, the offshore barges and other offshore platforms.

This crane 1 is hence useful, without being limited thereto, for the installation or dismantling of the transport infrastructures, the on-board reparations or operations.

The crane 1 comprises three main elements:

- a support structure 2, forming the interface of the crane 1 with the vessel,
- a boom 3, carried by the support structure 2, and
- a storage/traction system 4, for handling a cable C (partially shown in FIGS. 1 to 3) intended to hang/receive a load to be moved (not shown).

The support structure 2 advantageously consists of a barrel or mast, intended to be rotated about a vertical longitudinal axis, through operating means (not shown, advantageously hydraulic or electric).

The boom 3 is advantageously equipped with pulleys 51, which are sized, distributed and arranged in a customized manner, for guiding the cable C between the storage/traction system 4 and the load to be lifted.

The boom 3 here consists of a knuckle boom that comprises two boom parts 31, 32, assembled in series from the support structure 2, i.e. a main boom 32, and a terminal boom 33 (also called "jib").

The storage/traction system 4 forms a module that is fitted on the crane 1, advantageously carried by the support structure 2 (preferably opposed to the boom 3).

The storage/traction system 4 intervenes in the storage and the traction of the cable C, advantageously chosen among the synthetic cables.

The storage/traction system 4 comprises a frame 5 that carries a combination of devices 6, 7, 8 cooperating with the above-mentioned cable C (for the storage and the traction thereof), i.e.:

- a storage device 6, for storing the slack of the cable C,
- a traction device 7, adapted to exert a traction on the cable C for the winding/unwinding thereof with respect to the storage device 6, and
- a winding device 8, interposed between the storage device 6 and the traction device 7, for guiding the cable C during the winding/unwinding thereof with respect to the storage device 6.

Storage Device

Figure 4:
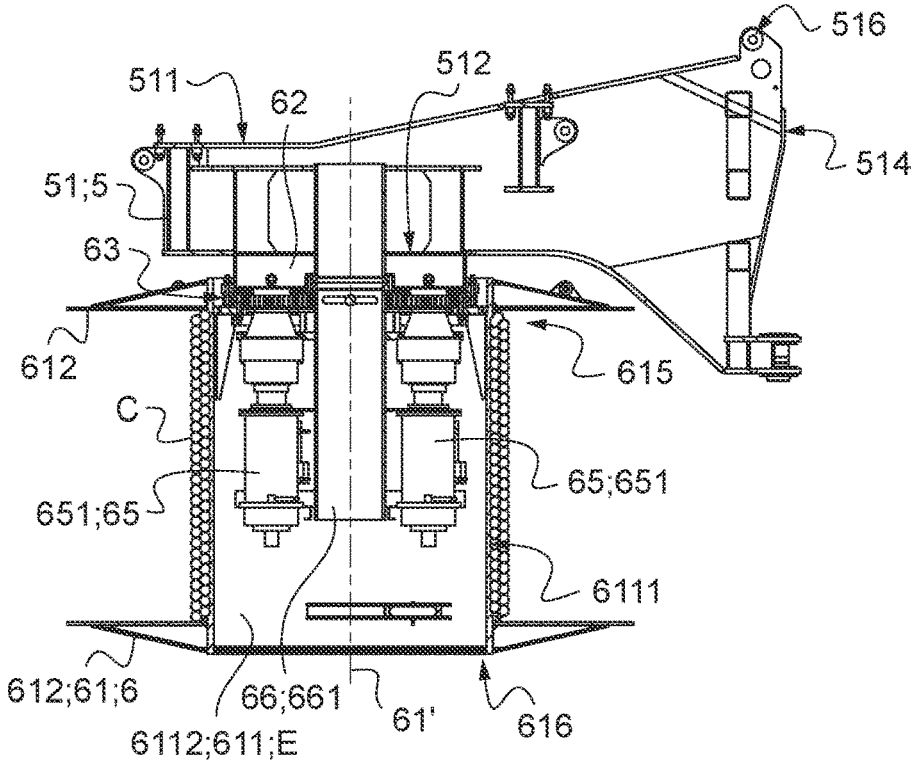
FIG. 4 shows the storage device fitted on the storage/traction system in accordance with FIG. 1, along a vertical section plane passing through the axis of rotation of the storage reel.
Figure 5:
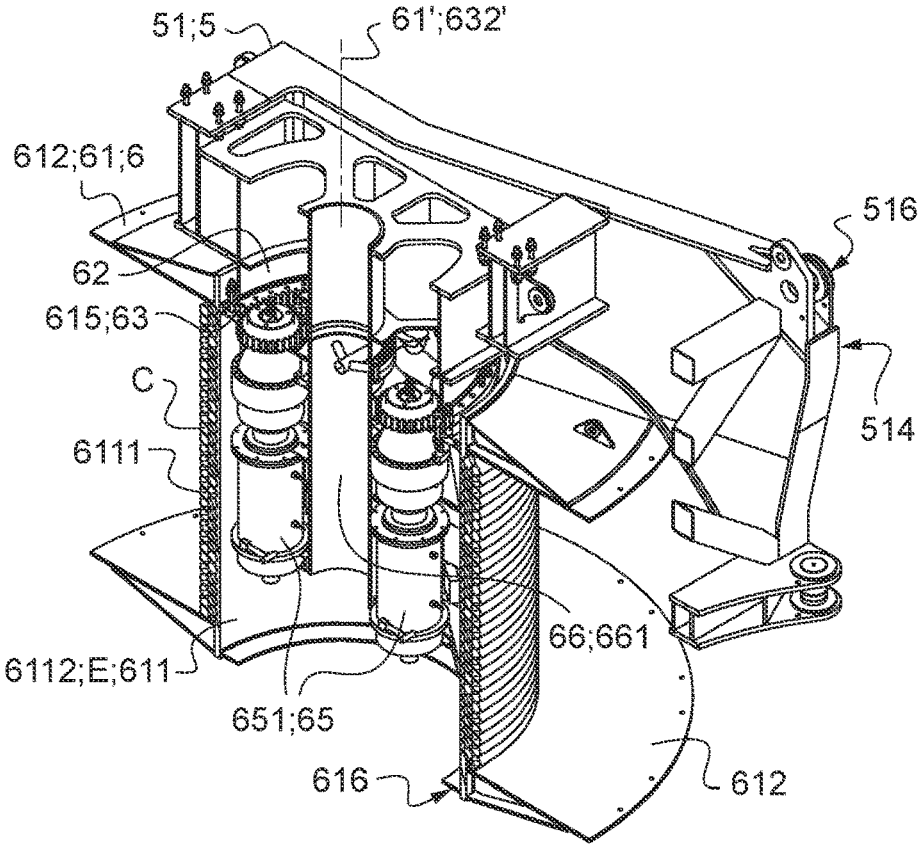
FIG. 5 is a cross-sectional perspective view of the storage device of FIG. 4.

As described hereinabove in relation with FIGS. 4 to 6, the storage device 6 includes:

- a storage reel 61 on which the cable C is intended to be wound,
- a support 62, carrying the storage reel 61 through assembly means 63 (visible in particular in FIG. 6) defining an axis of rotation 61' for the storage reel 61, and
- a motorization 65, adapted to rotate the storage reel 61 about its axis of rotation 61'.

The storage reel 61 here comprises a cylindrical barrel 611 ended by two flanges 612.

The tubular, cylindrical barrel 611 includes two opposite, cylindrical surfaces 6111, 6112, i.e.:

- an outer surface 6111, around which the cable C is intended to be wound, and
- an opposite, inner surface 6112, delimiting a cylindrical inner space E.

The storage reel 61, and in particular the cylindrical barrel 6111, also includes two end edges 615, 616 (or longitudinal edges), at which the two flanges 612 are positioned.

Here, the storage reel 61 is positioned in such a way as its axis of rotation 61' is directed vertically. And the two end edges 615, 616 of the storage reel 61 here define an upper end edge 615 (directed upward) and a lower end edge 616 (directed downward), respectively.

Figure 6:
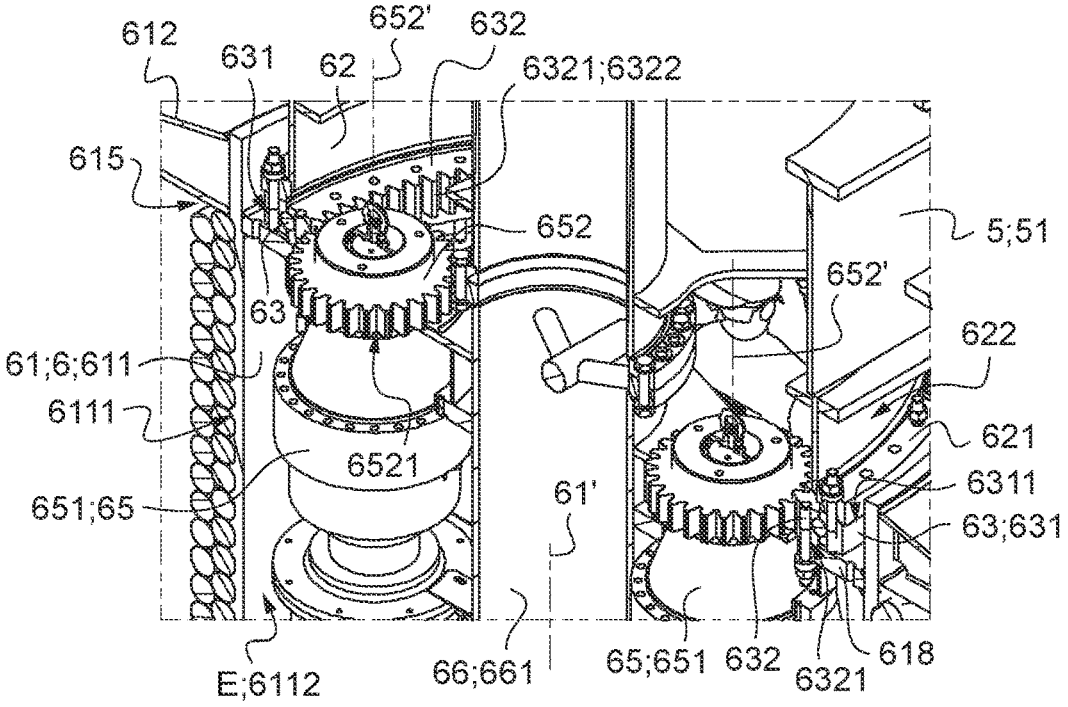
FIG. 6 is a partial and enlarged view of FIG. 5, showing in more detail the structure of the assembly means implanted between the storage reel and the support.

According to the invention, between the storage reel 61 and the support 62, the above-mentioned assembly means 63 consist of a single slewing ring (visible in particular in FIG. 6—denoted by the same reference 63 for the sake of simplification).

This single slewing ring 63 is advantageously coaxial to the axis of rotation 61', and it here extends in a horizontal general plane.

Here, the single slewing ring 63 comprises two rings 631, 632 that are free to rotate with respect to each other (coaxially to the above-mentioned axis of rotation 61'), i.e.:

- a fixed ring 631 (here, outer ring), which is fastened (preferably by bolting) to the support 62, and a moving ring 632 (here, inner ring), which is, on the one hand, fastened (preferably by bolting) to the storage reel 61 and, on the other hand, rotated by the motorization 65.

In particular, as described hereafter in relation with FIG. 6, the fixed ring 631 here includes an upper surface 6311 on which a support ring 621 is fastened by bolting; this ring 621 here ends a tubular skirt 622 of the support 62 that extends from the frame 5. And the moving ring 632 here includes a lower surface 6321 on which a plate 618 of the storage reel 61 is fastened by bolting.

The plate 618 of the storage reel 61 and the slewing ring 63 here extend in the plane of one of the flanges 612 (here the upper flange 612), advantageously to optimize the mechanical strength.

The two rings 631, 632 advantageously cooperate through a bearing, preferably a ball bearing.

Moreover, the moving ring 632 includes teeth 6321 (or toothing 6321), advantageously in the form of a straight toothing (denoted by the same reference 6321), to form a gear wheel.

The teeth 6321 are here distributed along an inner cylindrical surface 6322, parallel and coaxial to the axis of rotation 61' of the storage reel 61.

The moving ring 632 is hence intended to be rotated, by the motorization 65, about an axis of rotation 632' that is coaxial to the axis of rotation 61' of the storage reel 61.

The motorization 65 of the storage device 6 is advantageously implanted opposite the outer surface 6111 and/or the inner surface 6112 of the cylindrical barrel 611.

This motorization 65 is here positioned opposite the inner surface 6112 of the cylindrical barrel 611, in the cylindrical inner space E and between the two end edges 615, 616. The bulk of the storage device 6 is hence defined by its storage reel 61.

Here, the motorization 65 of the storage device 6 comprises at least two motors 651 (preferably, electric or hydraulic), preferably three motors, regularly distributed over the circumference (here, inner circumference) of the slewing ring 63.

These motors 651 are advantageously synchronized, through suitable control means.

The motors 651 are hence distributed about the axis of rotation 61' of the storage reel 61, between this axis of rotation 61' and the inner surface 6112 of the cylindrical barrel 611.

For that purpose, the motors 651 are here fastened to (and carried by) a support structure 66 that extends the frame 5.

This support structure 66 comprises in particular a central body 661 (advantageously cylindrical), also called "shaft", that extends from the frame 5 (here vertically and downward) and about which are distributed the motors 651.

The shaft 661 is surrounded by the storage reel 61, as the case may be by the inner surface 6112 of the cylindrical barrel 611.

The shaft 661 hence passes through a first end edge 615 (here, the upper one) of the storage reel 61 and extends over part of the height of the cylindrical inner space E (advantageously without exiting at a second end edge 616, here the lower one).

The motorization 65 (and in particular the motors 651) is hence implanted in the annular space defined between the shaft 661 (inside) and the inner surface 6112 of the cylindrical barrel 611 (outside).

For the operation of the moving ring 632, the motorization 65 of the storage device 6, and in particular each motor 651, includes a driving pinion 652 that meshes with the toothing 6321 of the moving ring 632.

The driving pinion 652 hence includes teeth 6521, here also defining a straight toothing (denoted by the same reference 6521).

The driving pinions 652 and the moving ring 632 then have parallel axes of rotation 652', 632' (FIG. 6).

The driving pinion 652 and the moving ring 632 then advantageously extend in a same plane, perpendicular to the axis of rotation 614, here a horizontal plane.

The driving pinion 652 hence cooperates with the toothing 6321 of the moving ring 632 so as to define together, in the present embodiment, a gear parallel and internal to the cylindrical wheel.

Each driving pinion 652 is hence implanted along the inner cylindrical surface 6322 of the moving ring 632, still preferably in the annular space defined between the shaft 611 (inside) and the inner cylindrical surface 6322 of the moving ring 632 (outside).

In particular, the storage reel 61 and the moving ring 632 have axes of rotation 61', 632', which are coaxial to each other. Each driving pinion 652 has an axis of rotation 652' that is parallel, and laterally offset, with respect to the axis of rotation 61' of the storage reel 61 and with respect to the axis of rotation 632' of the moving ring 632.

In the present embodiment, the single slewing ring 63 is implanted/positioned at a first end edge 615 of the storage reel 61; the support 62 is also implanted opposite this first end edge 615 of the storage reel 61.

In parallel, the second end edge 616 of storage reel 61 is then advantageously free, forming a through-opening to facilitate the access to the cylindrical inner space E.

Here, the storage reel 61 is assembled to the support 62 through assembly means 63 defining a vertical axis of rotation 61'.

Considering this vertical axis of rotation 61', the driving pinions 652 and the moving ring 632 also have vertical axes of rotation 652', 632' (FIG. 6).

The single slewing ring 63 and the support 62 are then advantageously implanted at the upper end edge 615 of the storage reel 61. The lower end edge 616 of the storage reel 61 is advantageously free.

The driving pinion 652 is then advantageously located at this same upper end edge 615 of the storage reel 61. The associated motor 651 is located under this driving pinion 652.

The lower end edge 616 (free) advantageously defines a through-opening, directed downward, to facilitate the access to the cylindrical inner space E.

Traction Device

The traction device 7, also called "winch", is adapted to exert a traction on the cable C.

Such a traction device 7 is advantageously chosen among the known traction devices and winches.

This traction device 7 advantageously consists of a capstan winch. Generally, it includes at least one drum 71, here two in number, associated with a motorization 72 (also called "motor means").

For example and without being limited thereto, the traction device 7 can be of the type described in document EP2178784.

Such a winch 7 is composed of two motorized drums 71, positioned opposite to each other.

Each drum 71 each includes an active cylindrical peripheral surface provided with several annular grooves, juxtaposed and coaxial to each other.

The cable C is intended to be wound about the two drums 71 according to a helical arrangement; the strands of the cable C pass successively from one of the annular grooves of a drum 71 to one of the annular grooves of the other drum 71.

Figure 3:
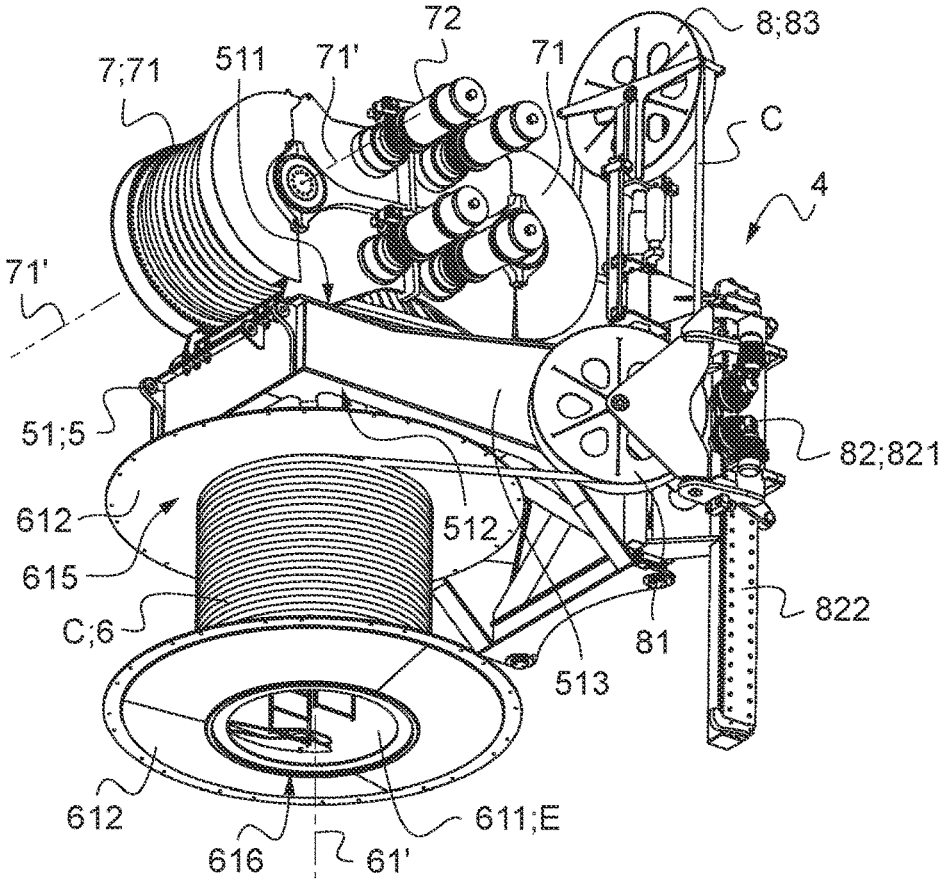
FIG. 3 is a general perspective view (from below) of the storage/traction system according to FIG. 1.

And, as illustrated in FIG. 3, the axis of rotation 71' of two motorized drums 71 is directed perpendicular (here, horizontally), or at least approximately perpendicular, to the axis of rotation 61' of the storage reel 61 (here, vertically).

Still in this document EP2178784, the motorized drums 71 are each formed of several pulleys, each rotatable about a common central axis 71', cooperating with their own dedicated motor means 72.

Winding Device

The winding device 8 is interposed between the storage device 6 and the traction device 7, to guide the cable C during the winding/unwinding thereof with respect to the storage reel 61.

Such a winding device 8 is advantageously chosen among the known winding devices.

Figure 2:
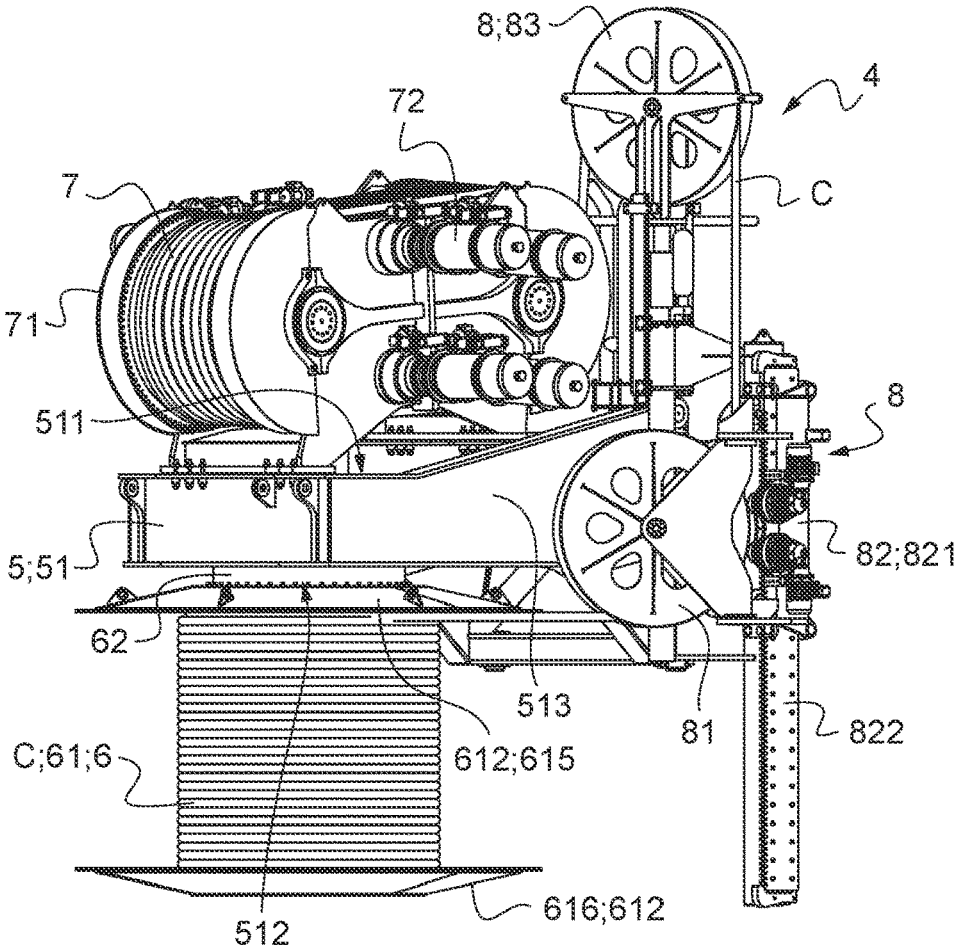
FIG. 2 is a general side view of the storage/traction system according to FIG. 1.

Here, as described in more detail in relation with FIG. 2, the winding device 8 can comprise two wheels for guiding the cable C:

- a moving wheel 81, associated with operating means 82 for the translation thereof along a direction parallel to the axis of rotation 61' of the storage reel 61 (for example, as a motorized carriage 821 mounted on a guiding rail 822), and
- a fixed wheel 82, for tensioning the cable C and ensuring the interface between the moving wheel 81 and the traction device 7.

Frame

The frame 5, advantageously a mechanically welded metallic structure, comprises a base 51 that is here in the form of a horizontal, here parallelepipedal, plate or platform.

This base 51 advantageously includes:

- two opposed surfaces: an upper surface 511 (directed upward) and a lower surface 512 (directed downward),
- lateral surfaces 513, and
- a rear surface 514.

The combination of devices 6, 7, 8 is implanted in a particular way on this base 51 in order to optimize the bulk of this storage device 6.

More particularly, the devices 6, 7, 8 are here distributed as follows about the base 51:

- the storage device 6 is located under the base 51, here opposite the lower surface 512,
- the traction device 7 is located above the base 51, here opposite the upper surface 511, and
- the winding device 8 is implanted laterally with respect to the base 51, here opposite one of the two lateral surfaces 513.

In other words, the storage device 6 is hung under the base 51. Within this framework, the support structure 66 of the motorization 65 (in particular, the shaft 661) is also hung under the base 51.

The base 51 also includes lateral fastening means 516 for its fastening to the offshore crane 1, in particular the support structure 2 thereof.

The lateral fastening means 516 consist for example of a mechanically welded structure 516 that is implanted at the rear surface 514.

Operating Method

In practice, the traction device 7 is implemented to exert a traction of the cable C for the winding/unwinding thereof with respect to the storage device 6 and with respect to the boom 3.

In parallel, the storage reel 61 is rotated by the associated motorization 65.

The single slewing ring 63 hence defines the axis of rotation 61' of the storage reel 61, here vertical.

During this rotation, the winding device 8 guides the cable C all along the winding/unwinding thereof with respect to the storage device 6.

Of course, various other modifications can be made to the invention within the scope of the appended claims.

The invention claimed is:

1. A system for the storage and traction of a cable, wherein said storage/traction system comprises a frame that carries a combination of devices cooperating with said cable:

(i) a storage device including:

a storage reel on which said cable is intended to be wound, a support, carrying said storage reel through assembly means defining an axis of rotation, and a motorization, adapted to rotate said storage reel about said axis of rotation, (ii) a traction device, adapted to exert a traction on said cable, wherein said traction device includes at least one drum associated with a motorization, and (iii) a winding device, interposed between said storage device and said traction device, to guide the cable during the winding/unwinding thereof with respect to said storage reel, wherein, between said storage reel and said support, said assembly means consist of a single slewing ring comprising two rings that are free to rotate with respect to each other:

a fixed ring that is fastened to said support, and a moving ring that is both fastened to said storage reel, and, also rotated by said motorization of the storage device.

2. The system for the storage and traction of a cable according to claim 1, wherein the storage reel comprises a cylindrical barrel that comprises two cylindrical surfaces:

an outer surface, around which the cable is intended to be wound, and an opposite, inner surface, and wherein the motorization of said storage device is implanted opposite said outer surface and/or said inner surface.

3. An offshore crane equipped with a storage/traction system according to claim 2.

4. The system for the storage and traction of a cable according to claim 1, wherein the motorization of said storage device comprises at least two motors, which are regularly distributed over the circumference of said slewing ring.

5. An offshore crane equipped with a storage/traction system according to claim 4.

6. The system for the storage and traction of a cable according to claim 1, wherein the moving ring includes a toothing and wherein the motorization of said storage device includes a driving pinion meshing with said toothing.

7. An offshore crane equipped with a storage/traction system according to claim 6.

8. The system for the storage and traction of a cable according to claim 1, wherein the storage reel includes two end edges, and wherein the slewing ring is positioned at one of said end edges of the storage reel.

9. An offshore crane equipped with a storage/traction system according to claim 8.

10. The system for the storage and traction of a cable according to claim 1, wherein said storage reel is assembled to the support through said assembly means defining a vertical axis of rotation.

11. The system for the storage and traction of a cable according to claim 10, wherein the storage reel includes two end edges: an upper end edge and a lower end edge, and wherein the slewing ring is located at said upper end edge.

12. An offshore crane equipped with a storage/traction system according to claim 11.

13. The system for the storage and traction of a cable according to claim 10, wherein the frame comprises a base on which said devices are implanted, wherein:

said storage device is located under said base, said traction device is located above said base, and said winding device is implanted laterally with respect to said base, and wherein said base also includes means for the lateral fastening to an offshore crane.

14. An offshore crane equipped with a storage/traction system according to claim 13.

15. An offshore crane equipped with a storage/traction system according to claim 10.

16. The system for the storage and traction of a cable according to claim 1, wherein the motorization of the storage device is carried by a shaft that is fastened to the frame and arranged coaxially to said axis of rotation, said shaft being surrounded by said storage reel by an inner surface of a cylindrical barrel.

17. An offshore crane equipped with a storage/traction system according to claim 16.

18. An offshore crane equipped with a storage/traction system according to claim 1.

* * * * *